United States Patent [19]

Huuskonen et al.

[11] 4,173,134

[45] Nov. 6, 1979

[54] APPARATUS AND METHOD FOR GUIDING A RING STRUCTURE DURING THE MANUFACTURE THEREOF

[75] Inventors: Niilo T. Huuskonen, Salem; Dante P. DiBattista, Lynn, both of Mass.

[73] Assignee: General Electric Company, Lynn, Mass.

[21] Appl. No.: 881,096

[22] Filed: Feb. 24, 1978

[51] Int. Cl.[2] ..... B21H 1/06

[52] U.S. Cl. ..... 72/10; 72/106; 72/110

[58] Field of Search ..... 72/106, 110, 10, 16, 72/247

[56] References Cited

U.S. PATENT DOCUMENTS

| | | | |
|---|---|---|---|
| 1,284,093 | 11/1918 | Grotnes | 72/106 |
| 1,428,778 | 9/1922 | Grotnes | 72/106 |
| 3,859,830 | 1/1975 | Jeuken et al. | 72/110 |
| 3,999,416 | 12/1976 | Brooks | 72/105 |

*Primary Examiner*—Lowell A. Larson

*Attorney, Agent, or Firm*—Henry J. Policinski; Derek P. Lawrence

[57] ABSTRACT

An apparatus and method are provided for maintaining a ring at a predetermined location with respect to a pair of roll forming dies during a roll forming manufacturing process. The apparatus and method may include variable width means adapted to be variable in response to changes in the axial width of the ring during the roll forming process and may further include sensing means for sensing variations in the axial width of said ring. The variable width means may be variable in response to said sensing means.

17 Claims, 8 Drawing Figures

APPARATUS AND METHOD FOR GUIDING A RING STRUCTURE DURING THE MANUFACTURE THEREOF

BACKGROUND OF THE INVENTION

This invention relates to a method and apparatus for manufacturing rings to a desired contour and radial diameter and, more particularly, to a method and apparatus for guiding the metal ring during its manufacture so as to maintain said ring at predetermined location with respect to a pair of roll forming dies.

Metal rings are used throughout industry in a wide variety of applications. Such rings are particularly useful in the construction of parts for gas turbine engines, including the construction of compressor casings, fan casings, combustor liners, and turbine shrouds. Since high temperature metal alloys used in the construction of these rings are relatively expensive and costly to machine, recent developments in the prior art have resulted in new processes wherein the metal ring is manufactured by rolling an initial annular blank between pairs of roll dies until a final contour and radial diameter are achieved without machining of the part. Generally, the initial annular blank is of substantially the same weight as the final ring, but of substantially lesser radial diameter, and the final ring contour and radial diameter is achieved by squeezing the annular blank between a pair of roll dies along its entire circumference so as to simultaneously expand the ring and form the desired final contour.

Prior art methods have utilized guide rolls for guiding the metal ring during the roll forming process. More specifically, these guide rolls, which do not deform the annular metal blank as do the roll forming dies, are spaced at selected locations along the circumference or periphery of the annular blank and serve to generally locate the metal ring with respect to the rolling dies. However, the roll guides known in the prior art are not sensitive to changes in axial width of the metal ring as it is being rolled into its final contour and radial diameter. The change in axial width of the metal ring during the rolling process may be either an increase in axial width or a decrease in axial width depending upon the final contour to be achieved. In either case, guiding or positioning of the work piece precisely as desired with respect to the roll forming dies cannot be achieved with prior art roll guides. By way of example, if the final width of the metal ring is smaller than the width of the initial annular blank, the prior art roll guides are dimensioned to be slightly larger than the width of the initial annular blank. Hence, during the rolling process, as the width of the initial annular blank decreases the clearance between the annular blank and the roll guides progressively increases such that the annular blank may move substantially within the confines of the roll guide. As the width of the annular blank progressively decreases, undesirable movement of the annular blank within the confines of the roll guide likewise increases and hence accurate positioning of the annular blank during the roll process is not accomplished. Conversely, if the width of the initial annular blank is smaller than the axial width of the final metal ring the width of the guide roll is dimensioned to be slightly larger than the width of the final metal ring. Consequently, in this latter instance, a large gap exists between the initial annular blank and the guide roll whereby the guide rolls are ineffective to precisely position the annular blank with respect to the roll forming dies during the initial stages of the rolling process. In either instance, lack of precise positioning or location of the annular metal blank with respect to the roll forming dies causes instability of the annular blank within the roll forming dies and can result in deformation of the annular blank in a manner incompatible with the final ring configuration to be achieved by roll forming process.

SUMMARY OF THE INVENTION

It is therefore the primary object of the present invention to provide a method and apparatus for guiding a metal ring during the manufacture thereof.

It is another object of the present invention to provide a method and apparatus for guiding a metal ring during progressive changes in the axial width thereof induced by the roll forming manufacturing process.

Briefly stated, these and other objects of the present invention which will become apparent from a reading of the following specification in conjunction with the appended drawings, are accomplished by the present invention wherein in one form a method of manufacturing a metal ring to a desired contour and radial diameter is comprised of the steps of providing a ring having an initial axial width, rolling the initial ring about a first axis of rotation between selected pairs of roll dies so as to progressively vary the axial width of said ring from the initial axial width to a second axial width and providing guide means for maintaining the ring at a preselected location with respect to the pair of roll dies during variations in the axial width of the ring. The guide means may be comprised of variable width means in the form of a variable width cavity which is defined by a pair of spaced apart rollers wherein the width of the cavity is varied in accordance with variations in the ring. Sensing means may be provided for sensing variations in the width of the ring and the guide means may be responsive to the sensing means. Apparatus for accomplishing the aforedescribed method is also claimed to be a part of the present invention.

BRIEF DESCRIPTION OF THE DRAWINGS

The present invention may be better understood from a reading of the following specification with reference to the appended drawings wherein.

DESCRIPTION OF THE PREFERRED EMBODIMENT

Figure 1:
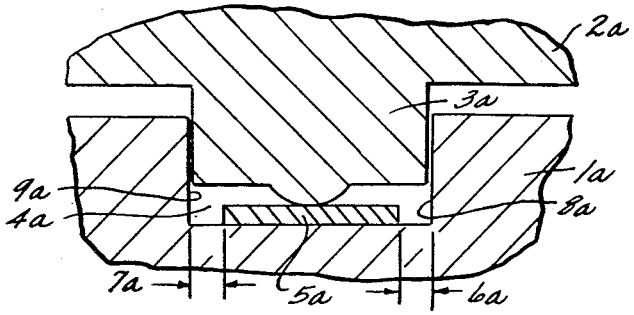
FIG. 1 is a schematic view of the interface between a work piece and a pair of roll forming dies under prior art conditions.
Figure 2:
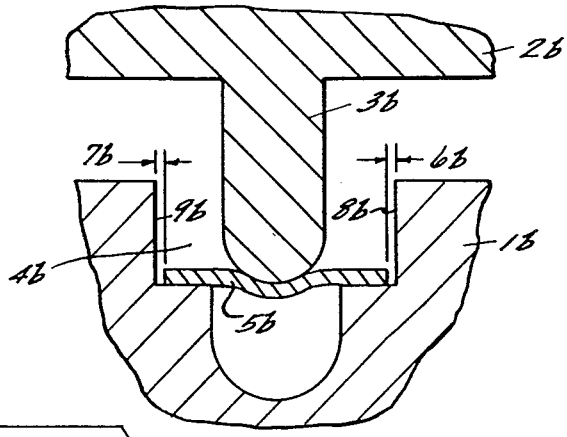
PRIOR ART Fig 2
FIG. 2 is a schematic view of the interface between a work piece and a pair of roll forming dies under prior art conditions.

Referring now to FIGS. 1 and 2, which depict diagrammatically the orientation of an annular work piece disposed within the forming dies used in the roll forming process, the problem addressed by the present invention will first be discussed.

FIG. 1 depicts a pair of complimentary inner and outer roll forming dies 1*a* and 2*a*, respectively, disposed in an interfitting relationship. Protrusion 3*a* depends from outer roll die 2*a* into recess 4*a*, formed in inner roll die 1*a*. Retained within recess 4*a* annular work piece 5*a* is engaged by inner roll die 1*a* and outer roll die 2*a* for the purpose of roll forming annular work piece 5*a* to a desired contour and radial diameter. As depicted in FIG. 1 annular work piece 5*a* is in the early or first stages of the roll forming process such that clearances 6*a* and 7*a* exist between the annular work piece 5*a* and the side walls 8*a* and 9*a* of recess 4a in inner roll dies 1*a*. As inner roll die 1*a* and outer roll die 2*a* are moved towards each other the annular work piece is squeezed thereby reducing its radial thickness and increasing its axial width until the final desired contour and radial diameter are achieved. It can be seen however that during the initial stages of roll forming, where clearances 6*a* and 7*a* are large, no substantial restraints are imposed upon annular work piece 5*a* to prevent its axial movement or to maintain it centered within cavity 4*a*.

Referring now to FIG. 2, a pair of inner and outer complimentary roll forming dies 1*b* and 2*b* respectively are depicted disposed in an interfitting relationship. While FIG. 1 depicted the roll forming process wherein the width of the annular blank increased during rolling, FIG. 2 depicts the roll forming process wherein the width of the annular blank decreases during rolling. Protrusion 3*b* depends from outer roll die 2*b* into recess 4*b* disposed within inner roll die 1*b*. Work piece 5*b* is captured within recess 4*b* and engaged by inner roll die 1*b* and outer roll die 2*b* for the purpose of roll forming annular work piece 5*b* to a desired contour and radial diameter. As depicted in FIG. 2 annular work piece 5*b* is in the early or first stages of the roll forming process such that clearances 6*b* and 7*b* exist between the annular work piece 5*b* and the side walls 8*b* and 9*b* of recess 4*b* in roll die 1*b*. Hence, even in these early stages of rolling, the presence of clearances 6*b* and 7*b* preclude precise axial positioning of the annular work piece 5*b* within recess 4*b*. Moreover, as the roll forming process proceeds, the axial width of work piece 5*b* progressively decreases, clearances 6*b* and 7*b* progressively increase and hence precise axial positioning of work piece 5*b* within recess 4*b* is even further precluded.

It is readily observed then that in the prior art roll forming processes depicted in FIG. 1 and 2 the variations in axial width of the annular work piece preclude accurate and precise positioning of the annular work piece with respect to the roll forming dies. Consequently, undesirable movement of the blank during the process may result in deformation of the annular blank by the roll dies in a manner incompatible with the final ring configuration to be achieved by the roll forming process. By way of example precise axial symmetry of the work piece may be destroyed or specific deformations of certain areas of the work piece may be dislocated.

Figure 3:
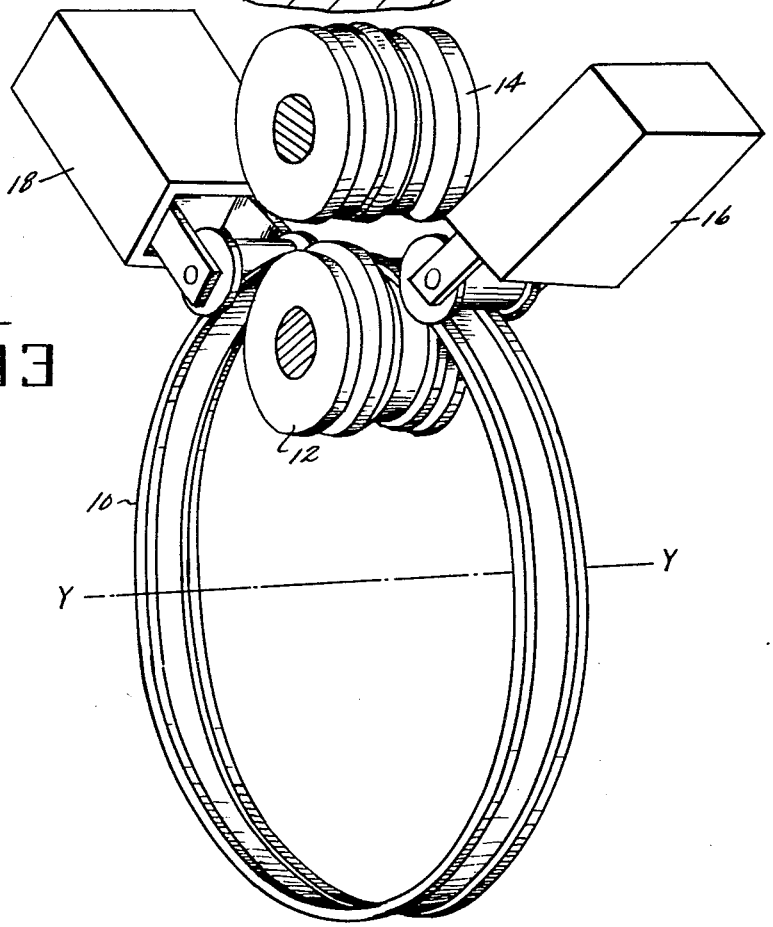
PRIOR ART Fig 3
FIG. 3 is a perspective view of the apparatus comprising the present invention.

Referring now to FIG. 3, the method and apparatus comprising the present invention will now be described. Annular blank or ring 10 is disposed between a pair of roll dies 12 and 14 and arranged perpendicular to axis y—y, the axis of rotation of annular blank or ring 10. Generally, during the roll forming process, roll forming dies 12 and 14, both of which rotate, are moved relatively towards each other and squeeze ring 10 therebetween so as to form a desired cross-sectional contour in ring 10 and increase its diameter. Said another way, the ring is rolled about a first axis of rotation between selected pairs of roll dies 12 and 14 so as to progressively vary the axial width of the ring from an initial axial width to a second axial width.

A more complete description of the roll forming process may be readily obtained from a reading of U.S. Pat. No. 3,999,416 issued to Ralph Chesley Brooks and entitled "Cold Rolling a Contour in Metal Rings." Generally, the roll forming process utilizes a suitable ring configuration as the starting material. The initial ring may be formed by rolling a strip or bar of metal stock into a ring shape and thereafter joining the ends to form a ring. Any suitable method known in the art which results in a relatively smooth and clean joint may be utilized to join the ends. Minor discontinuities at the joint can be removed in subsequent rolling operations. The starting ring configuration may be formed by other suitable processes such as by back extruding a metal billet to form a cylinder and thereafter slicing the cylinder into ring structures. The weight of the initial ring must be carefully selected so as to be exactly equal to the weight of the desired final ring structure since no material is wasted in forming the final ring. The initial diameter of the starting ring should be considerably less (typically one-half) than that of the desired final ring structure.

The initial ring is successively rolled between selected pairs of circular dies made from a suitable metal alloy so as to contour the ring which is concurrently enlarged in radial diameter. Further, the rolling operations may be performed on either cold ring structures or hot rolling techniques may be used in the early stages of rolling in order to more rapidly approximate the axial contour early in the rolling operation.

The number of roll die sets required will depend upon the degree of contouring desired and the work hardening tendency of the material which is utilized. Each pair of rolled dies must be carefully selected so as to achieve the maximum amount of material movement without causing fracture of the ring.

Referring again to FIG. 3, variable width guide means in the form of spaced-apart guide members or rollers 16 and 18 are disposed in close proximity to and in operative engagement with annular ring 10. Guide roll 16 and 18 maintain ring 10 in a predetermined position or location with respect to roll dies 12 and 14 during variations in the axial width of the ring 10 while the ring 10 is progressively contoured and radially enlarged during the roll forming process. As will hereinafter be more fully explained, the variable width means, in the form of variable guide roll 16 and 18, defines a cavity having a variable axial width, variable in accordance with progressive variations in the axial width of the annular ring 10. Said another way, the variable width means are variable in accordance with variations in the axial width of the ring 10 and is adapted to maintain ring 10 in a predetermined location.

Figure 4:
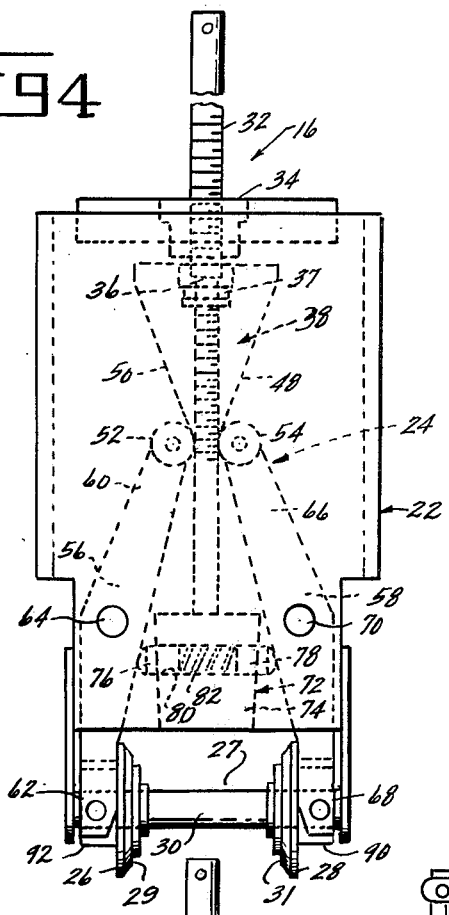
FIG. 4 is a top view of the variable width guide roll comprising a part of the present invention.
Figure 5:
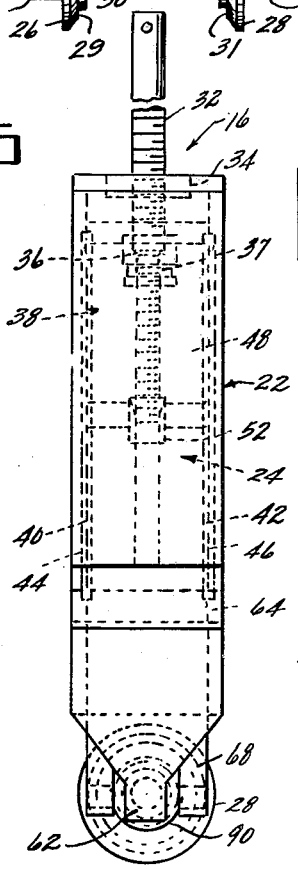
FIG. 5 is a side view of the variable width guide roll depicted in FIG. 4.

Referring now to FIGS. 4 and 5 a plane view and a top view are respectively depicted of a portion of one of the 16 variable width guide rollers. The portion of the variable width guide roll not depicted in FIGS. 4 and 5 relates to the mechanism for withdrawing or advancing the entire guide roll away from and toward the ring 10 and may be comprised of structure well known in the art. Guide roller 18 is identical to roller 16 and therefore need not be described in great detail.

Variable width guide roll 16 is comprised of hollow housing 22 in which variable width actuating mechanism, denoted generally at 24, resides. Actuating mechanism 24 operatively engages a pair of spaced apart guide rollers 26, 28 journaled to rotate on shaft 30 affixed to housing 22. As will more fully be hereinafter explained actuating mechanism 24 is adapted to selectively vary the space or width between rollers 26, 28 in accordance with variations in the width of the ring 10 (not shown in FIGS. 4 or 5) during the rolling process. More specifically, guide rollers 26 and 28 are spaced apart to define a cavity 27 in which the work piece resides. The cavity 27 is at least partially defined by inwardly-facing spaced apart surfaces 29 and 31 on guide rolls 26 and 28 respectively. Actuating mechanism 24 is adapted to vary the spacing between surfaces 29 and 31 and hence the width of cavity 27 is likewise varied.

Actuating mechanism 24 is comprised of an elongated actuating shaft 32 threadably engaged with bushing 34 secured to housing 22. One end 36 of shaft 32 is received in relief 37 disposed in drive wedge 38 whereby shaft 32 is disposed in abutting operative engagement with drive wedge 38. Rotation of actuating shaft 32 within bushing 34 advances or withdraws shaft 32 into and out of housing 22, depending upon the direction of rotation. Advancement of shaft 32 into housing 22 serves to displace drive wedge 38 which is constrained to translate within housing 22. More specifically, drive wedge 38 is provided with a pair of elongated keys 40, 42 adapted to reside in a pair of keyways 44, 46, respectively, disposed in housing 22 whereby drive wedge 38 is constrained to translate back and forth along the direction of extention of keyways 44 and 46.

Drive wedge 38 is provided with a pair of cam surfaces 48, 50 adapted to engage respectively a pair of cam followers 52, 54 rotatably mounted to a pair of elongated lever arms 56, 58 respectively. Lever arm 56 includes a pair of end portions 60 and 62 with cam follower 52 being rotatably mounted on end portion 60. End portion 62 protrudes from housing 22 and is adapted to operatively engage variable width guide roller 26. Lever arm 56 is pivotally mounted inside housing 22 upon pivot pin 64 at a point intermediate end portions 60 and 62. Lever arm 58 is provided with a pair end portion 66 and 68 with cam follower 54 being rotatably mounted on end portion 66. End portion 68 extends exterior to housing 22 and is adapted to operatively engage variable width guide rolls 28. Lever arm 58 is pivotally mounted inside housing 22 upon pivot pin 70 disposed at a point intermediate end portions 66 and 68.

Return mechanism 72 is comprised of base 74, fixedly secured to housing 22, a pair of spaced-apart plungers 76, 78 residing partially in recess 80 in base 74. Return spring 82 disposed between spaced apart plungers 76, 78 and adapted to bias plungers 76, 78 away from each other and into engagement with lever arms 56 and 58, respectively.

As shaft 32 is rotated and thereby advanced into housing 22, drive wedge 38 is displaced toward cam followers 52 and 54. The wedging action due to the operative engagement of followers 52 and 54 with cam surfaces 50 and 48, respectively, causes cam followers 52 and 54 to be displaced away from one another. More specifically as cam follower 52 rides up cam surfaces 50, the follower 52 is displaced leftward (as viewed in FIG. 4) causing lever arm 56 to rotate counter clockwise about pivot pin 64. Similarily, as cam follower 54 rides up cam surface 48, the follower 54 is displaced rightward (as viewed in FIG. 4) causing lever arm 58 to rotate clockwise about pivot pin 70.

Rotation of lever arm 56 counter clockwise and lever arm 58 clockwise moves guide rollers 26 and 28 toward each other thereby decreasing the axial separation between surfaces 29 and 31 and hence decreasing the width of cavity 27. More specifically, lever arm 56 displaces roller 26 to the right while lever arm 58 displaces roller 28 to the left. Hence, the guide roll 16 is provided with a variable width cavity 27 whereby variations in width of ring 10 may be accommodated.

Upon rotation of shaft 32 in a direction so as to withdraw shaft 32 out of housing 22, the biasing force generated by return spring 82 is sufficient to cause plungers 76 and 78 to drive lever arms 56 and 58 clockwise and counter clockwise, respectively, whereby the distance between guide rollers 26 and 28 is permitted to increase. In this manner then the width of cavity 27 is increased.

Figure 6:
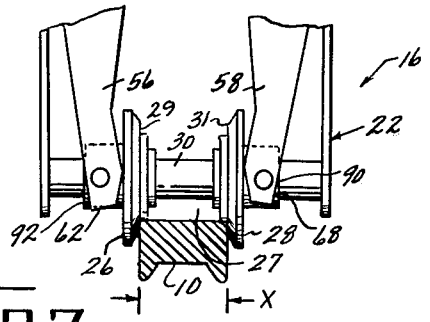
FIG. 6 is an enlarged view of a portion of the apparatus depicted in FIG. 4 during initial stages of the rolling process.
Figure 7:
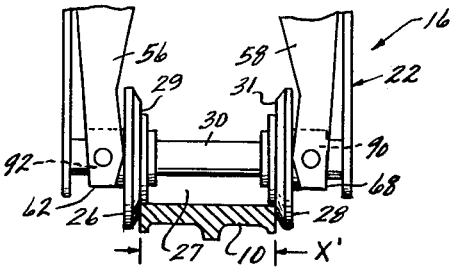
FIG. 7 is an enlarged view of a portion of the apparatus depicted in FIG. 4 during later stages of rolling.

Referring now to FIGS. 6 and 7, variable width roll guide 16 is depicted as associated with ring 10 in the early and late stages of the roll forming process, respectively. In the early stages of the roll forming process, the ring 10 has an axial width x. As the roll forming process progresses the ring 10 is progressively rolled between roll dies 12 and 14 (not shown in FIGS. 6 and 7) whereby its diameter is increased substantially while a desired contour is formed in the work piece. During these progressive rolling operations the axial width of the ring 10 is increased from the initial axial width x to a final axial width x'. As viewed in FIGS. 6 and 7, the present invention permits the rollers 26 and 28 to follow the changes in axial width of the ring 10 during each and every stage of the rolling process. Hence rollers 26 and 28 can maintain the ring 10 precisely located with respect to the roll forming dies 12 and 14 as the axial width of ring 10 increases from width x to width x'.

In some instances, it may be desirable to maintain a very slight clearance between surface 29 on roller 26 and the ring 10 and between surface 31 on roller 28 and the ring 10. The purpose of providing such clearance is to reduce the friction between the ring 10 and the rollers 26 and 28. In the instance where such slight clearance is maintained it has been found that the purposes and accomplishments of the present invention are not disrupted. That is to say, even with the slight clearances present, rollers 26 and 28 are effective to keep the ring 10 precisely located with respect to the roll forming dies 12 and 14.

As previously explained, the axial width of the variable guide roll, or in other words the distance separating rollers 26 and 28, is varied in accordance with variations in the axial width of the ring through rotation of shaft 32. Shaft 32 may be actuated manually by the operator of the roll forming machine via a handwheel, right angle drive and a reduction gear, none of which are shown in the Figures but each of which is well known in the art. That is to say, the operator manually adjusts the position of shaft 32, and hence the width separating rollers 26 and 28, in accordance with a preselected schedule known to the operator as appropriate to provide a separation between rollers 26 and 28 which is equal to or very closely approximate to the axial width of the ring 10 as it is rolled in the forming process. In this manner, the operator then manually adjusts the spacing between rollers 26 and 28 to accommodate variations in the axial width of the work piece.

Figure 8:
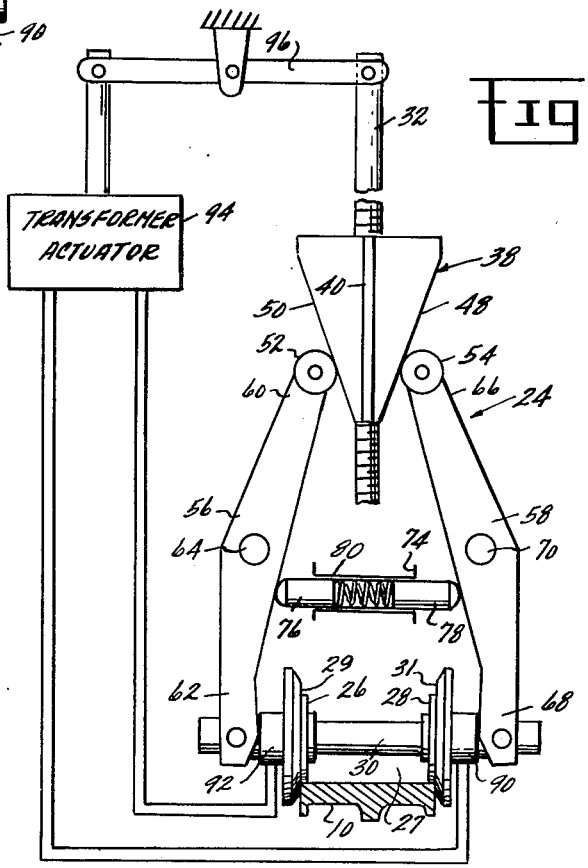
FIG. 8 is a schematic view of apparatus comprising the present invention including sensing means.

As an alternative to manual control described immediately above, it is within the scope of the present invention to provide for automatic control of the variable guide roll apparatus. Referring now to FIG. 8, a schematic representation of an automated variable guide roll apparatus is depicted. Generally, the variable guide roll mechanism, depicted schematically in FIG. 8, is identical to that depicted in FIGS. 4 and 5 with, however, the addition of sensing means in the form of a pair of sensors 90 and 92, a transformer/actuator 94, and a linkage member 96. Sensors 90 and 92 are adapted to provide a signal indicative of the position of the ring 10 relative to the guide rolls. Said another way, sensors 90 and 92 are adapted to sense variations in the axial width of the ring 10. More specifically, in the instance the ring 10 increases in axial width during the roll forming process, the spacing between inwardly-facing, spaced-apart surfaces 29 and 31 on guide rollers 26 and 28 respectively is set slightly larger than the initial axial width of the ring 10. As roll forming is initiated, the ring 10 is subjected to a force from the roll forming dies causing an increase in the axial width of the ring 10. As the rolling process proceeds the axial width of the ring 10 will eventually increase to a width sufficient to cause ring 10 to contact surfaces 29 and 31 so as to exert an axial force on guide rollers 26 and 28. Sensors 90 and 92 are adapted to sense the force exerted on guide rolls 26 and 28 and transmit signals to transformer/actuator 94 in response thereto. Transformer/actuator 94 upon the receipt of signals from both sensor 90 and sensor 92 is adapted to control guide rollers 26 and 28 in response to the signal by displacing linkage member 96 in a manner designed to move shaft 32 and drive wedge 38 in a direction increasing the spacing between guide rollers 26 and 28 until a slight clearance is again established between the ring 10 and surfaces 29 and 31. In this manner then the variable width means is responsive to sensors 90 and 92.

More specifically, when the ring 10 has increased in axial width such that it exerts an axial force on each of guide rollers 26 and 28, sensors 90 and 92 transmit electrical signals to transformer/actuator 94. Upon receipt of electrical signals from each of sensors 90 and 92, transformer/actuator 94 is adapted to rotate linkage member 96 slightly counter-clockwise (as viewed in FIG. 8) thereby causing drive wedge 38 to move slightly upward due to linkage member 96. Movement of drive wedge 38 upward permits lever arm 58 to rotate counter-clockwise about pivot 70 and lever arm 56 to rotate clockwise about pivot 64 whereby the distance between guide rollers 26 and 28 is permitted to increase slightly, thereby restoring the clearance between rollers 26, 28 and the ring 10.

As the roll-forming process progresses, the axial width of the ring 10 continues to increase until the ring 10 again contacts surfaces 29 and 31 on rollers 26, 28 whereupon sensors 90 and 92 are again activated to cause a further separation between rollers 26 and 28. In this manner then the separation between rollers 26 and 28 is automatically varied, or successively increased by slight amounts, during the entire roll forming process in response to sensors 90 and 92 thereby automatically accommodating axial growth of the ring 10.

In the event it is desired to roll form a ring 10 in a manner reducing its axial width, the apparatus described immediately above may be adapted to provide for successive decreases in the distance separating rollers 26 and 28. More specifically, the apparatus may be arranged such that surfaces 29 and 31 are initially in engagement with the ring 10. As rolling is initiated, sensors 90 and 92 sense disengagement of the ring 10 with either surface 29 or surface 31. In the event of such disengagement, transformer/actuator 94 may be adapted to effect movement of linkage member 96 clockwise causing drive wedge 38 to move downward thereby reducing the separation between rollers 26 and 28 until engagement between surfaces 29 and 31 and the ring 10 is again achieved.

It should be understood that the preferred embodiments of the present invention as herein before described are illustrative of a number of forms of the present invention and that a number of other forms are possible without departing from the scope of the invention as set forth in the appended claims. In this regard, it should be further understood that the automated variable guide roll may be provided using various either electrical, hydraulic, pneumatic transformer/actuators, or combinations thereof. Additionally, the location of the sensors may be placed other than in close proximity to guide rollers 26 and 28.

We claim:

1. For use in a method of manufacturing a metal ring to a desired contour and radial diameter the steps comprising:

providing an initial metal ring having an initial axial width;

rolling the initial ring about a first axis of rotation and between selected pairs of roll forming dies so as to progressively vary the axial width of said ring from said initial axial width to a second axial width;

providing a pair of axially spaced-apart guide members disposed adjacent to said ring and adapted to maintain said ring in a predetermined location with respect to said roll forming dies;

providing sensing means for sensing variations in said axial width of said ring; and varying the axial spacing between said spaced-apart guide members in response to said sensing means.

2. The invention as set forth in claim 1 wherein said guide members are comprised of a pair of guide rollers.

3. The invention of claim 1 wherein said step of providing guide members includes providing variable width means variable in accordance with said variations in axial width of said ring, said variable width means adapted to maintain said ring at said predetermined location.

4. The invention as set forth in claim 3 wherein said step of providing variable width means is comprised of providing a variable width cavity.

5. The invention as set forth in claim 4 wherein said cavity is at least partially defined by a pair of rollers.

6. The invention as set forth in claim 4 wherein the width of said cavity is varied in accordance with variations in the width of said ring.

7. For use in manufacturing metal rings to a desired final axial width and radial diameter from an initial metal ring having an initial axial width, the apparatus comprising:

a pair of rotating roll forming dies adapted for relative movement toward each other and to receive said initial metal ring therebetween, said dies further adapted to rotate said initial metal ring about a first axis of rotation and to progressively vary the axial width of said initial ring from said initial axial width to a second axial width;

a pair of axially spaced-apart guide members disposed adjacent to said ring and adapted to maintain said ring in a predetermined axial location with respect to said roll forming dies; and means for varying the axial spacing between said spaced-apart members in accordance with variations in the axial width of said ring, said means adapted to decrease said spacing when said relative movement of said roll dies decreases said axial width and to increase said spacing when said relative movement of said roll dies increases said axial width of said ring.

8. The invention as set forth in claim 7 wherein said guide members are comprised of a pair of guide rollers.

9. The invention as set forth in claim 7 further comprising sensing means for sensing said variations in axial width of said rings.

10. The invention as set forth in claim 9 wherein said varying means is responsive to said sensing means to vary said spacing.

11. For use in manufacturing metal rings to a desired final axial width and radial diameter from an initial metal ring having an initial axial width, the apparatus comprising:

a pair of rotating roll forming dies adapted for relative movement toward each other and to receive said initial metal ring therebetween, said dies further adapted to rotate said initial metal ring about a first axis of rotation and to progressively vary the axial width of said metal ring from said initial axial width to a second axial width;

guide means for maintaining said ring at a predetermined location with respect to said pair of roll forming dies during rolling of said ring;

sensing means for providing a signal indicative of the axial width of said ring; and actuator means for controlling said guide means in response to said signal.

12. The invention as set forth in claim 11 wherein said guide means is comprised of a pair of spaced apart guide rollers and said actuator means is adapted to vary the spacing between said rollers in accordance with said signal.

13. The invention as set forth in claim 12 wherein said actuator means is adapted to provide for an increase in the spacing between said guide rollers as the axial width of said ring increases.

14. The invention as set forth in claim 12 wherein said actuator means is adapted to provide for a decrease in the spacing between said guide rollers as the axial width of said ring decreases.

15. For use in manufacturing metal rings to a desired final axial width and radial diameter from an initial metal ring having an initial axial width, a variable width guide roll apparatus comprising:

a housing;

a drive wedge constrained to move within said housing, said drive wedge including a pair of cam surfaces;

an actuating shaft adapted for advancement into and withdrawal out of said housing, said shaft disposed in operative abutment with said drive wedge;

a pair of elongated lever arms each having a pair of end portions and each lever arm pivotally mounted for rotation within said housing, each of said lever arms having a cam follower disposed at one end portion thereof in engagement with one of said cam surfaces;

a pair of axially spaced-apart guide rollers journaled to rotate on a shaft affixed to said housing, said spacing defining a cavity having a variable axial width, each of said guide rollers in operative engagement with the other of said pair of end portions of one of said lever arms, said lever arms rotatable in response to movement of said wedge for varying said axial width of said cavity.

16. The apparatus as set forth in claim 15 further comprising:

a return mechanism in engagement with said pair of lever arms.

17. The apparatus as set forth in claim 15 further comprising:

sensing means for providing a signal indicative of the axial portion of said rings relative to said guide rollers; and actuator means receiving said signal for moving said drive wedge in response to said signal.

* * * * *